US012753670B1

(12) United States Patent
Newton et al.

(10) Patent No.: US 12,753,670 B1
(45) Date of Patent: Oct. 6, 2026

(54) SYSTEMS AND METHODS OF DEPLOYING A WIPER PLUG IN A DOWNHOLE TUBULAR STRING

(71) Applicant: Halliburton Energy Services, Inc., Houston, TX (US)

(72) Inventors: Daniel Newton, Singapore (SG); Nathan Barrett Wyatt, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/284,304

(22) Filed: Jul. 29, 2025

(51) Int. Cl.
*E21B 33/068* (2006.01)
*E21B 33/16* (2006.01)
*E21B 43/10* (2006.01)

(52) U.S. Cl.
CPC ..... *E21B 33/068* (2013.01); *E21B 33/16* (2013.01); *E21B 43/10* (2013.01)

(58) Field of Classification Search
CPC ..... E21B 33/16; E21B 33/068; E21B 43/10
See application file for complete search history.

(56) References Cited

U.S. PATENT DOCUMENTS

| | | | | |
|---|---|---|---|---|
| 4,378,838 | A * | 4/1983 | Ogden | E21B 33/16 166/155 |
| 4,393,931 | A * | 7/1983 | Muse | E21B 43/10 166/212 |
| 4,624,312 | A | 11/1986 | McMullin | |
| 5,040,603 | A | 8/1991 | Baldridge | |
| 5,052,488 | A | 10/1991 | Fraser, III | |
| 5,095,808 | A | 3/1992 | Baldridge | |
| 5,411,082 | A | 5/1995 | Kennedy | |
| 5,413,172 | A | 5/1995 | Laurel | |
| 6,712,152 | B1 | 3/2004 | Yokley et al. | |
| 7,513,311 | B2 | 4/2009 | Gramstad et al. | |
| 7,926,578 | B2 * | 4/2011 | Moffitt | E21B 43/10 166/380 |
| 8,305,228 | B2 | 11/2012 | Vigneaux | |
| 9,169,699 | B2 | 10/2015 | Rytlewski | |
| 9,605,492 | B2 | 3/2017 | Dietz | |
| 9,896,926 | B2 | 2/2018 | Steele | |
| 10,221,638 | B2 | 3/2019 | Turley et al. | |
| 10,316,626 | B2 * | 6/2019 | Keshishian | E21B 43/10 |
| 10,428,595 | B2 | 10/2019 | Bradley et al. | |
| 10,539,007 | B2 | 1/2020 | Dirksen et al. | |
| 10,711,593 | B2 | 7/2020 | Gao et al. | |
| 10,745,978 | B2 | 8/2020 | Liess | |
| 10,954,723 | B2 | 3/2021 | Sullivan et al. | |
| 11,814,927 | B1 * | 11/2023 | Schmidt | E21B 21/103 |
| 2008/0251253 | A1 * | 10/2008 | Lumbye | E21B 33/165 166/317 |

(Continued)

FOREIGN PATENT DOCUMENTS

| | | | |
|---|---|---|---|
| EP | 1256691 | A2 | 11/2002 |

OTHER PUBLICATIONS

International Search Report and Written Opinion mailed Apr. 24, 2026 in PCT/US2025/042066.

*Primary Examiner* — Shane Bomar
(74) *Attorney, Agent, or Firm* — The Hilton Firm PLLC

(57) ABSTRACT

A system comprising a liner hanger, a tubular housing configured to be coupled to an end of the liner hanger. A wiper plug assembly is removably coupled to the tubular housing by a breakable holder. The wiper plug assembly configured to be coupled to an end of a liner hanger running tool.

18 Claims, 5 Drawing Sheets

(56) References Cited

U.S. PATENT DOCUMENTS

| | | | | |
|---|---|---|---|---|
| 2009/0032241 | A1* | 2/2009 | Allen | E21B 33/03 166/375 |
| 2009/0101345 | A1* | 4/2009 | Moffitt | E21B 7/20 175/203 |
| 2009/0107675 | A1* | 4/2009 | Eriksen | E21B 33/14 175/203 |
| 2009/0200040 | A1* | 8/2009 | Smith, Jr. | E21B 43/103 166/380 |
| 2010/0218951 | A1* | 9/2010 | Harris | E21B 33/16 166/290 |
| 2012/0234561 | A1* | 9/2012 | Hall | E21B 23/02 166/386 |
| 2014/0196912 | A1* | 7/2014 | Turley | E21B 43/10 166/85.1 |
| 2019/0003265 | A1 | 1/2019 | McLaughlin | |
| 2022/0195835 | A1* | 6/2022 | Acosta Villarreal | E21B 34/063 |
| 2024/0110462 | A1 | 4/2024 | Al-Mousa et al. | |

* cited by examiner

SYSTEMS AND METHODS OF DEPLOYING A WIPER PLUG IN A DOWNHOLE TUBULAR STRING

TECHNICAL FIELD

The present disclosure relates generally to the deployment of a wiper plug in a casing or liner string of a well.

BACKGROUND

Hydrocarbon-bearing subterranean or subsea formations may be accessed by drilling a wellbore with a drill bit positioned on an end of a drill string. As the wellbore is formed, casing or liners are often deployed in the well to prevent collapse of the wellbore. After installing a casing or liner in a wellbore, the casing/liner is cemented by delivering cement through the casing/liner to an annulus between the casing and the wellbore. Often, multiple strings of casing/liners are installed in a wellbore as the well is progressively drilled to deeper depths. Prior to cementing operations, a wiper plug may be used to wipe the interior of the casing/liner as cement and the wiper plug are pumped down the string. This helps prevent contamination of the cement by treatment fluids already present in the casing/liner.

BRIEF DESCRIPTION OF THE DRAWINGS

Illustrative examples of the present disclosure are described in detail below with reference to the attached drawing figures, which are incorporated by reference herein, and wherein.

Figure 1:
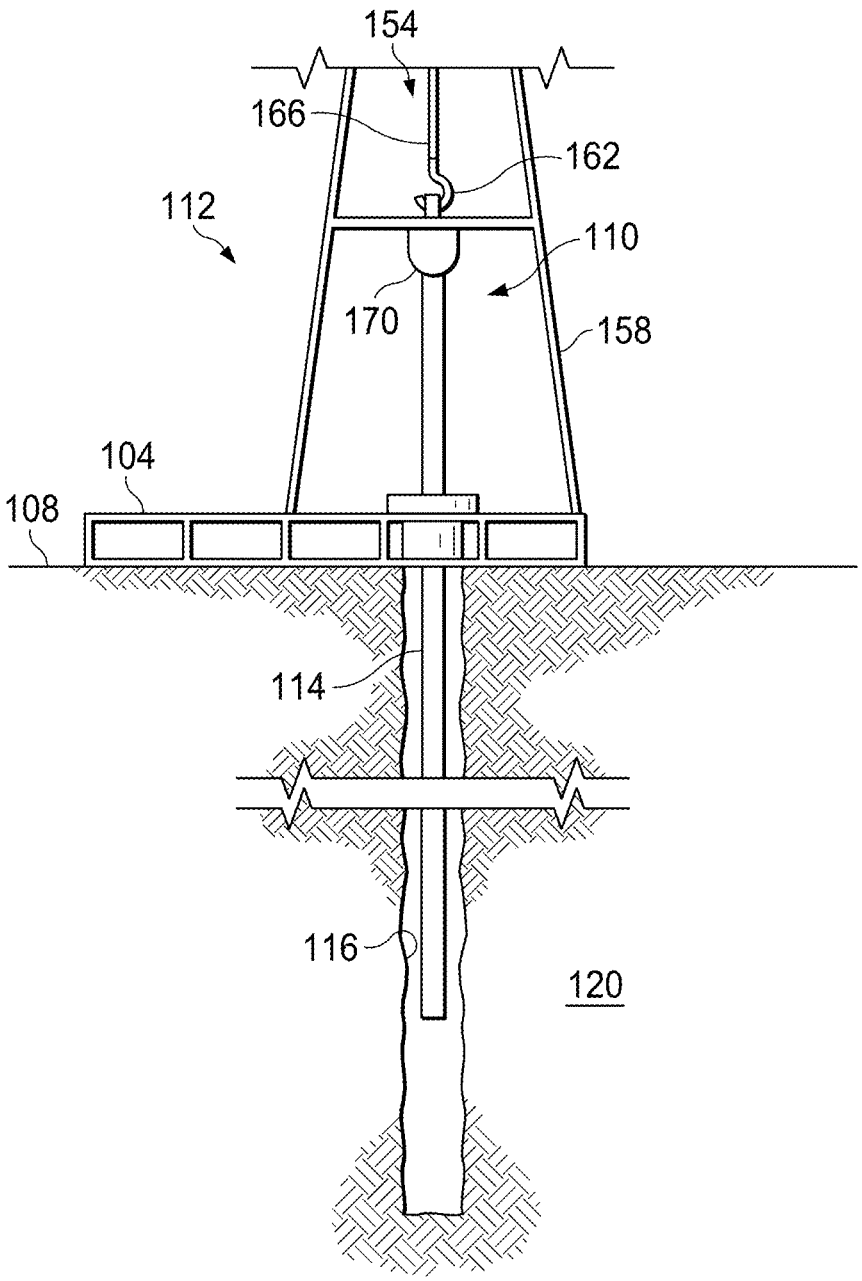
FIG. 1 is a schematic of a subterranean well having a system of wiping a downhole tubular string according to an illustrative embodiment, the system having a wiper plug assembly secured within a tubular housing.

The illustrated figures are only exemplary and are not intended to assert or imply any limitation with regard to the environment, architecture, design, or process in which the different examples may be implemented.

DETAILED DESCRIPTION

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

As used herein, reference to "casing" or a "casing string" may be used interchangeably with "liner" or a "liner string," as both casing and liner refer to protective tubing or conveyances placed in a wellbore to protect against collapse of the wellbore and to prepare the well for completion and ultimately production of formation fluids. A string of casing/liner refers to one or more sections of casing/liner coupled to one another.

The present disclosure relates generally to a system and method to deploy a wiper plug in a downhole tubular string such as a casing string or a liner string. Wiper plugs are often used during cementing operations in wells. Cementing is performed to seal a wellbore annulus between the walls of a wellbore and the casing or liner in the wellbore. Cement deployed in the annular space helps secure the casing or liner in the well and also serves to prevent the wellbore annulus from becoming a fluid path for drilling, treatment, or even production fluids.

When cementing operations begin, the casing or liner string being cemented often has fluids such as drilling mud in the interior of the casing or liner string. A wiper plug is typically deployed into the casing/liner string to serve as a barrier between the drilling mud in the casing/liner and the cement that is being pumped into the casing/liner behind the wiper plug. The wiper plug, which includes elastomeric extensions, is moved downhole through the casing/liner by the pressure of the cement behind it. As the wiper plug travels downhole it wipes the inner wall of the casing/liner to remove the mud or other fluids and also prevent contamination of the cement. At the bottom of the casing/liner string, the wiper plug typically stops on a float shoe or float collar attached to the bottom of the casing/liner.

A second or upper wiper plug is then delivered downhole through the casing/liner with mud or treatment fluid being used to push the upper wiper plug downhole. Again, the wiper plug prevents contamination of the cement by the treatment fluid and also displaces the cement through the first wiper plug and into the wellbore annulus.

While wiper plugs play an important role in a cementing operation, deployment of wiper plugs can be time consuming and costly. A wiper plug may be delivered to a wellbore at the end of a workstring or running tool that is run into the casing or liner string. Connecting a separate wiper plug assembly to a workstring or running tool can provide challenges. The coupling mechanism for such wiper plug assemblies are typically threads that must be made up on the rig floor. Depending on the casing size in which the wiper plug is to be deployed, the weight of a wiper plug assembly is often 50 to 200 pounds, which makes it difficult for personnel on the rig floor to manipulate and hold the wiper plug assembly while threading the wiper plugs to the workstring. An alternative solution could be to have a workstring, such as a liner hanger running tool, with a pre-installed wiper plug assembly, but this also presents challenges. Liner hanger running tools and associated liner hangers are often already 40 feet in length. The addition of a wiper plug assembly pushes the total length above 40 feet which exceeds the length requirements for standard shipping and containment solutions.

The systems and methods described herein overcome these issues by providing a wiper plug assembly that is positioned within a tubular housing. The wiper plug assembly is secured to the tubular housing by a breakable holder. The breakable holder may be broken by applying a force to the breakable holder. As described herein, in some examples, the breakable holder may be broken by application of mechanical force such as the weight of a running tool or other equipment, by application of a mechanical piston force, or by application of fluid pressure, either directly to the breakable holder or through a piston exposed to the fluid. In other embodiments, the breakable holder may be removed by drilling through the breakable holder causing a release of the wiper plug assembly from the tubular housing. By providing a means to secure the tubular housing at the rig floor, the connection of a running tool to the wiper plug assembly does not require personnel to be in the immediate vicinity during the connection process. The tubular housing may be coupled on one end to the liner or casing string already deployed in the wellbore. The wiper plug assembly and the running tool (or other workstring) are configured to be coupled without manually rotating one of the components (i.e., without a threaded connection). After coupling the running tool to the wiper plug assembly by stabbing one into the other, the breakable holder may be broken to release the wiper plug assembly from the tubular housing.

FIG. 1 illustrates a schematic view of a well 112 having a system 110 to deploy a wiper plug within a casing or liner string 114. The well 112 includes a wellbore 116 that extends from a surface 108 of the well 112 to a subterranean substrate or formation 120. The well 112 and rig floor 104 are illustrated on-shore in FIG. 1, but alternatively, the well could be a subsea well accessed by an off-shore platform (not illustrated).

In the embodiments illustrated in FIG. 1, the wellbore 116 has been formed by a drilling process in which dirt, rock and other subterranean material is removed to create the wellbore 116. Following the drilling process, a portion of the wellbore 116 is cased with casing or liner string 114. The lowering of the casing or liner string 114 may be accomplished by lift assembly 154 associated with a derrick 158 positioned on or adjacent to the rig floor 104. The lift assembly 154 may include a hook 162, a cable 166, a traveling block (not shown), and a hoist (not shown) that cooperatively work together to lift or lower a swivel 170 that is coupled to either the casing or liner string 114 or other workstrings or running tools used to case, line or cement the well 112. Additional sections of the casing or liner string 114 may be added until the casing or liner string 114 is assembled to a desired length.

Although FIG. 1 illustrates the process of casing or lining the wellbore, and the subsequent wiping and cementing operation that occurs after landing the casing or liner string in the wellbore, the system 110 and the wiper plug assemblies described herein may be used in any wellbore operation that requires the use of a wiper plug.

FIGS. 2-5 illustrates schematic views of a system 210 for wiping a liner or casing according to an embodiment of the disclosure. The system 210 includes a wiper plug assembly 214 positioned within a tubular housing 218. The wiper plug assembly 214 includes an upper assembly portion 222 and a releasably coupled wiper plug 226. The upper assembly portion 222 is an elongated tubular with an internal passage. An annulus 230 is formed between the upper assembly portion 222 and the tubular housing 218, and the wiper plug assembly 214 is secured within the tubular housing 218 by a breakable holder 234. In one embodiment, the breakable holder 234 may be a frangible disc or ring that is positioned around the upper assembly portion 222 and engages a wall of the tubular housing 218. The breakable holder 234 may be constructed from glass, laminated glass, ceramic or another breakable or frangible material that allows release of the wiper plug assembly 214 from the tubular housing 218 upon the application of a force. In some embodiments, a drillable holder may be used to secure the wiper plug assembly 214 to the tubular housing 218 in a similar manner to the breakable holder 234. The drillable holder may be removed by drilling, which would effectuate the release of the wiper plug assembly 214. The drillable holder may be constructed from metal, cement, or another material that could suitably be used to secure the wiper plug assembly 214 and could be removed by drilling.

The wiper plug assembly 214 and tubular housing 218 together represent a self-contained system that simplifies the process of connecting a wiper plug to a running tool, or workstring, while also keeping the lengths of run-in tools and hangers within standard transportation and containment regulations. By simplifying the connection process, the system 210 also reduces the exposure of rig personnel while connections are being made on the rig floor. The tubular housing 218 includes a first end 238 and a second end 242 with coupling capabilities. In an embodiment, the second end 242 includes a threaded coupling that mates with a liner or casing string 248 being deployed in the wellbore.

Figure 2:
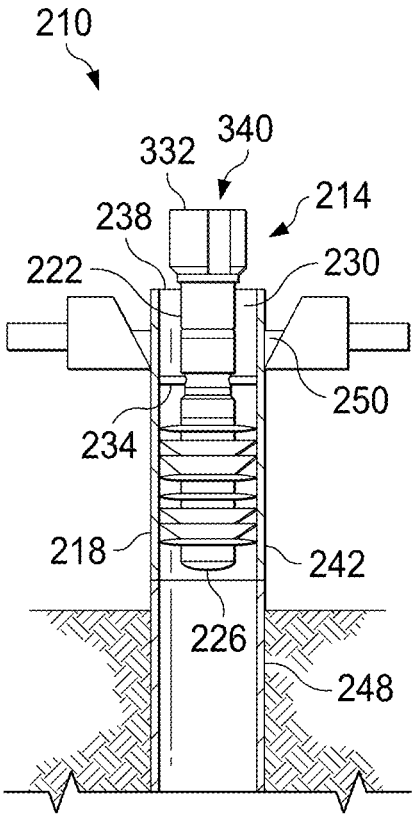
FIG. 2 is a schematic view of a system of wiping a downhole tubular string according to an illustrative embodiment, the system having a wiper plug assembly secured within a tubular housing.

In FIG. 2, the tubular housing 218 has been connected to the liner string 248 deployed in the wellbore, and the tubular housing 218 is held at the rig floor by slips 250. The slips 250 secure the tubular housing 218 and liner string 248 before the liner string 248 is advanced further into the wellbore. The securement of the tubular housing 218 presents an advantage in that the wiper plug assembly 214 can now be attached to other components without causing rig personnel to support the wiper plug assembly 214 while a threaded connection is made.

Figure 3:
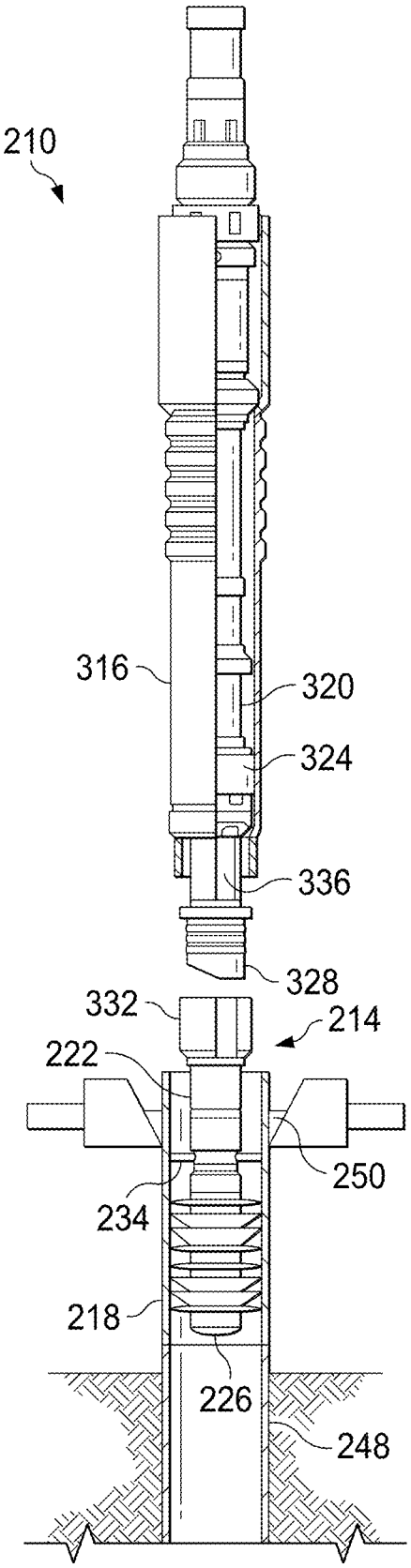
FIG. 3 is a schematic view of the system of FIG. 2 with a liner hanger running tool configured for attachment to the wiper plug assembly.

In FIG. 3, a liner hanger 316 and a liner hanger running tool 320 are lowered toward the wiper plug assembly 214. The liner hanger 316 is carried by the liner hanger running tool 320. Collets 324 on the liner hanger running tool 320 prevent the release of the liner hanger 316 until the liner hanger 316 is finally positioned in the wellbore. The liner hanger running tool 320 includes a sealing latch 328 that is configured to mate with a latch receiver 332 on the wiper plug assembly 214. The sealing latch 328 and latch receiver 332 are each part of an anchor latch coupling device. In an embodiment, the anchor latch coupling device includes a threaded split ring on the sealing latch 328 that allows threads to jump threads within the latch receiver when the two components are coupled together, yet requires unthreading the two halves to de-couple. This allows the liner hanger running tool 320 and the wiper plug assembly 214 to be coupled without manually threading the components, which eliminates the need to rotate the wiper plug assembly 214 multiple times in order to make the connection. In some embodiments, the latch receiver may be positioned on the liner hangar running tool 320 instead of being positioned on the wiper plug assembly 214. In such embodiments, the sealing latch 328 is positioned on the wiper plug assembly 214 to allow the connection between the liner hangar running tool 320 and the wiper plug assembly 214.

Figure 4:
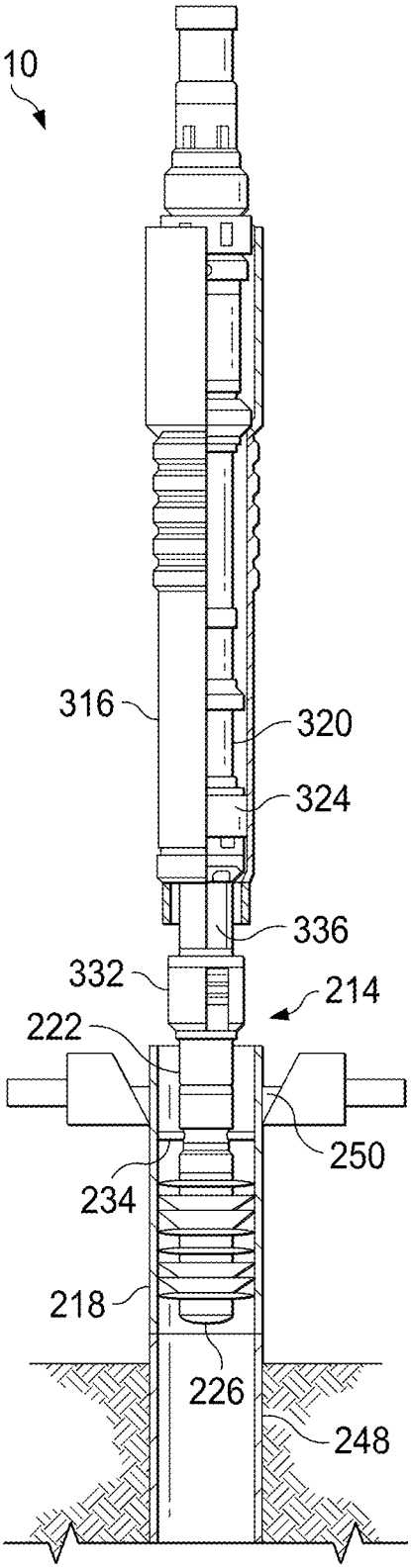
FIG. 4 is a schematic view of the system of FIG. 3 with the liner hanger running tool attached to the wiper plug assembly.

In FIG. 4, the liner hanger running tool 320 is lowered toward the wiper plug assembly 214 until the sealing latch 328 is received by the latch receiver 332. When fully seated in the latch receiver 332, the sealing latch 328 is coupled to the latch receiver 332 in a manner that did not require threaded rotation of the wiper plug assembly 214 or the liner hanger running tool 320. The joint made between the latch receiver 332 and the sealing latch 328 may be a sealed joint, but in some embodiments, the joint may not be a sealed joint. When the joint is sealed, fluid communication may be provided between a passage 336 of the liner hanger running tool 320 and an internal passage of the upper assembly portion 222 of the wiper plug assembly 214.

After the wiper plug assembly 214 and the liner hanger running tool 320 are coupled as shown in FIG. 4, the joint between the wiper plug assembly 214 and the liner hanger running tool 320, if a sealed joint, may be pressure tested by pumping fluid through the passage 336 and into the internal passage of the upper assembly 214 portion. In some embodiments, this pressure testing will take place at the surface of the well, but in others, the joint could be pressure tested within the wellbore. The advantage of pressure testing at the surface is that a leak in the joint's seal could be more easily addressed before running downhole.

Figure 5:
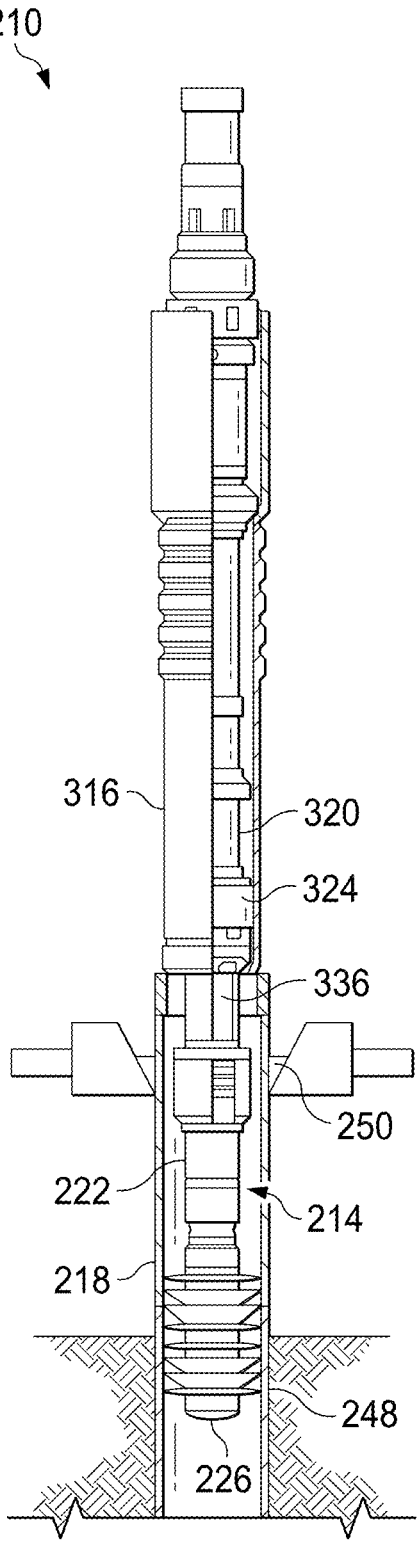
FIG. 5 is a schematic view of the system of FIG. 3 with the wiper plug assembly released from the tubular housing.

In FIG. 5, the liner hanger running tool 320 may be lowered such that the weight of the liner hanger running tool 320 and the liner hanger 316 exert a downward force on the wiper plug assembly 214 thereby breaking the breakable holder 234 and allowing the wiper plug assembly 214 to release from the tubular housing 218. While in the embodiment illustrated, the breakable holder 234 is broken at the surface of the well, in other alternative embodiments, the breakable holder 234 may be broken after the wiper plug assembly 214 and tubular housing 218 are within the wellbore. Similarly, the breakable holder 234 may be broken in alternative ways from the weight-down process described above. Alternatives for breaking the breakable holder are described below with reference to FIGS. 6-8.

After releasing the wiper plug assembly 214 from the tubular housing 218 as shown in FIG. 5, the wiper plug assembly 214 may be moved through the tubular housing 218 such that the liner hanger 316 comes into contact with, engages, and couples to the first end 238 of the tubular housing 218. The coupling mechanism may be threads or any other suitable coupling, but in some embodiments, the liner hanger 316 and tubular housing 218 are coupled in the same manner as other sections the liner string 248.

The liner hanger 316, liner hanger running tool 320, wiper plug assembly 214, and liner string 248 may then be lowered into the wellbore until the desired depth is reached. The liner hanger 316 may then be secured within the wellbore and the wiper plug 226 deployed to wipe the liner string 248 prior to cementing operations. The liner hanger running tool 320 and the upper assembly portion 222 may also be removed following use of the wiper plug 226.

Figure 6:
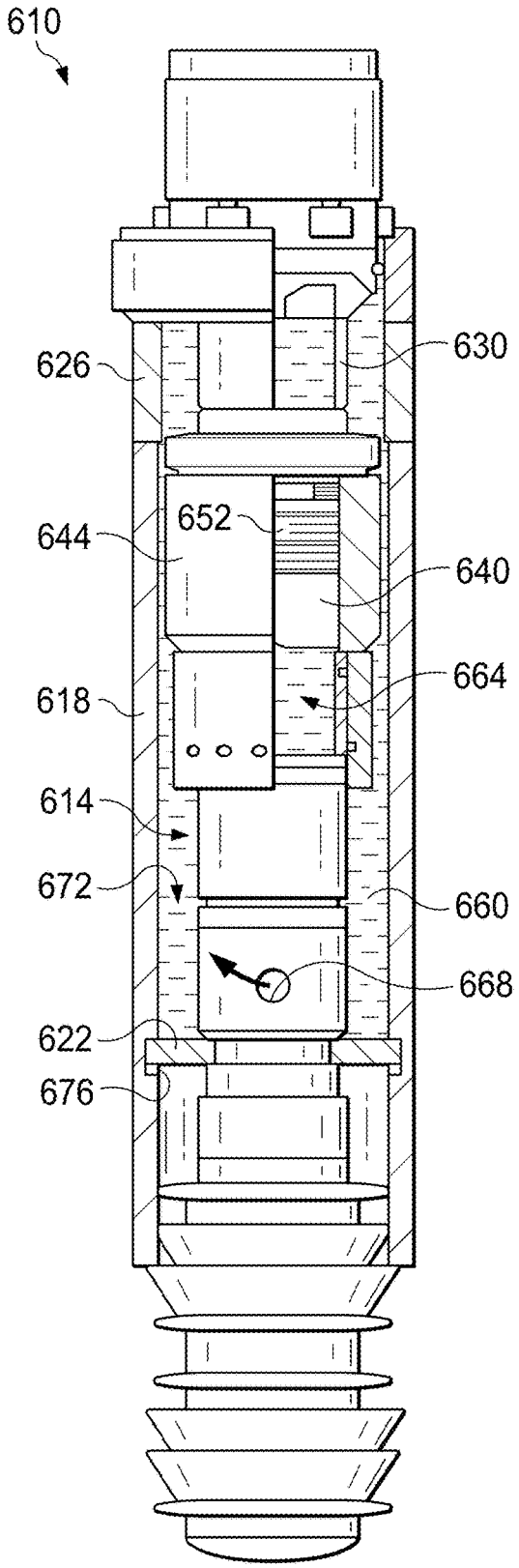
FIG. 6 is a schematic view of a system of wiping a downhole tubular string according to an illustrative embodiment, the system having a wiper plug assembly secured within a tubular housing.
Figure 7:
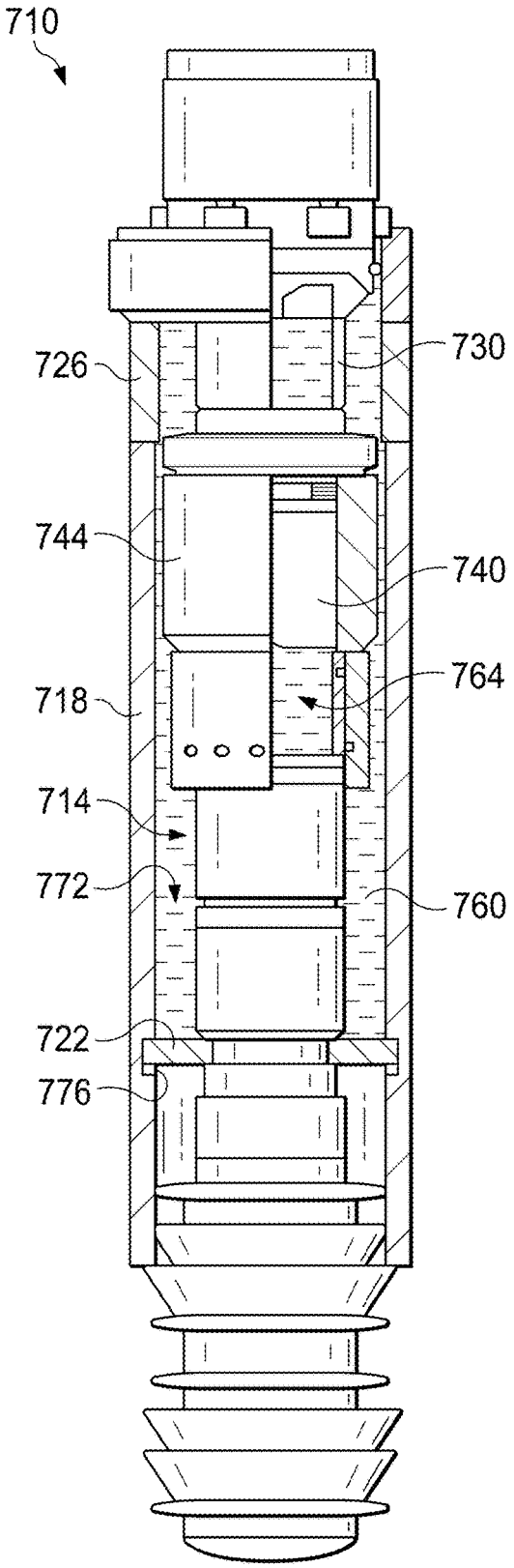
FIG. 7 is a schematic view of a system of wiping a downhole tubular string according to an illustrative embodiment, the system having a wiper plug assembly secured within a tubular housing.
Figure 8:
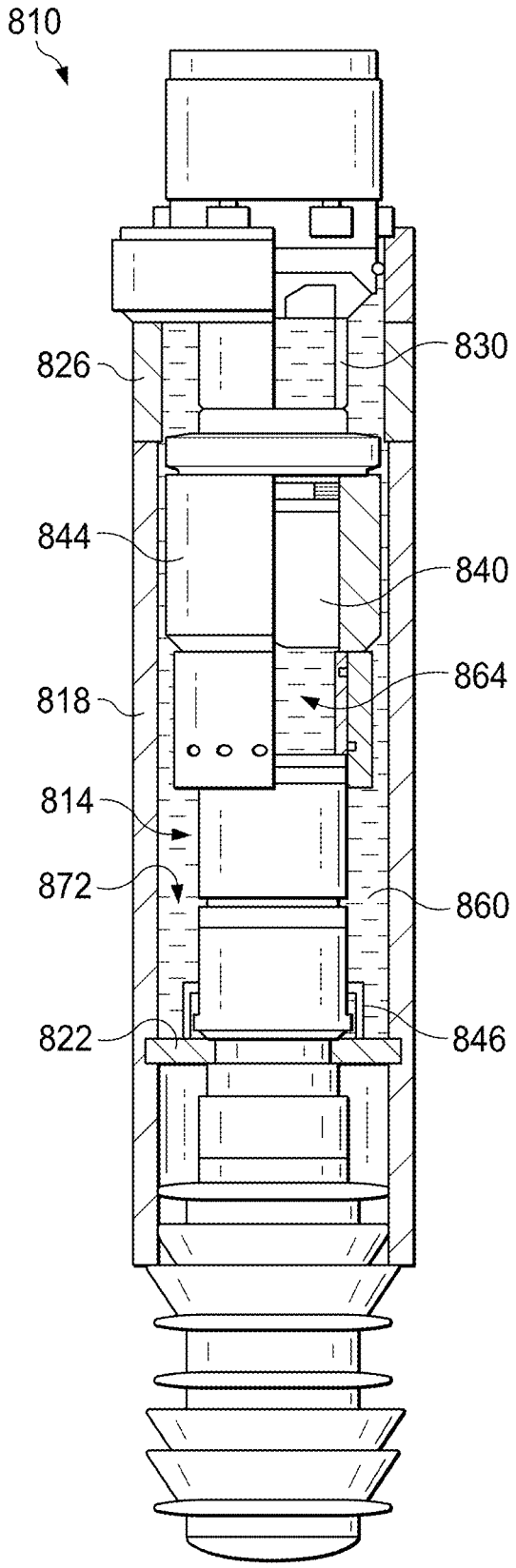
FIG. 8 is a schematic view of a system of wiping a downhole tubular string according to an illustrative embodiment, the system having a wiper plug assembly secured within a tubular housing.

FIGS. 6-8 each illustrate schematic views of wiper systems 610, 710, 810 according to an illustrative embodiment. The systems include wiper plug assemblies similar to the wiper plug assembly 214. In FIG. 6, a wiper plug assembly 614 is positioned within a tubular housing 618. The wiper plug assembly 614 is secured by a breakable holder 622 such that the wiper plug assembly 614 is not capable of being pushed out of the tubular housing 618 without breaking the breakable holder 622. The tubular housing 618 in the illustrated embodiment is coupled to a liner hanger 626 and the wiper plug assembly 614 is coupled to a liner hanger running tool 630. The connection between the wiper plug assembly 614 and the liner hanger running tool 630 is preferably accomplished by a sealing latch 640 and a latch receiver 644. In FIG. 6, the sealing latch 640 and the latch receiver 644 are sealed by seals 652 to form a sealed joint.

The wiper system 610 of FIG. 6 uses the direct application of fluid pressure to break the breakable holder 622 when needed. A fluid 660 is pumped through an interior passage 664 of the wiper plug assembly 614 and exits an orifice 668 of the wiper plug assembly 614 to fill an annulus 672 between the wiper plug assembly 614 and the tubular housing 618. As pressure of the fluid 660 increases in the annulus 672, a force is applied to the breakable holder 622. The breakable holder 622 may be held within a recess of the wall of the tubular housing 618, with a pin 676 or other shattering device positioned in the recess in contact with the breakable holder 622. The pin 676 supports the breakable holder 622 and has a small contact area, which concentrates stress in the breakable holder 622 causing the breakable holder 622 to break when the fluid pressure is raised in annulus 672.

In FIG. 7, a wiper plug assembly 714 is positioned within a tubular housing 718. The wiper plug assembly 714 is secured by a breakable holder 722 such that the wiper plug assembly 714 is not capable of being pushed out of the tubular housing 718 without breaking the breakable holder 722. The tubular housing 718 in the illustrated embodiment is coupled to a liner hanger 726, and the wiper plug assembly 714 is coupled to a liner hanger running tool 730. The connection between the wiper plug assembly 714 and the liner hanger running tool 730 is preferably accomplished by a latch 740 and a receiver 744. In FIG. 7, the latch 740 and the receiver 744 are unsealed, which is different than the joint arrangement in FIG. 6.

The wiper system 710 of FIG. 7 also uses the direct application of fluid pressure to break the breakable holder 722 when needed. A fluid 760 is pumped through an interior passage 764 of the wiper plug assembly 714. Instead of flowing through an orifice, the fluid flows through the unsealed joint into an annulus 772 between the wiper plug assembly 714 and the tubular housing 718. As pressure of the fluid increases in the annulus 772, a downward force is applied to the breakable holder 722. A pin 776 or other shattering device positioned in contact with the breakable holder 722 concentrates stress in the breakable holder 722 causing the breakable holder to break when the fluid pressure is raised in annulus 772.

In FIG. 8, a wiper plug assembly 814 is positioned within a tubular housing 818. The wiper plug assembly 814 is secured by a breakable holder 822 such that the wiper plug assembly 814 is not capable of being pushed out of the tubular housing 818 without breaking the breakable holder 822. The tubular housing 818 in the illustrated embodiment is coupled to a liner hanger 826, and the wiper plug assembly 814 is coupled to a liner hanger running tool 830. The connection between the wiper plug assembly 814 and the liner hanger running tool 830 is preferably accomplished by a latch 840 and a receiver 844. In FIG. 8, the latch 840 and the receiver 844 are unsealed similar to the arrangement in FIG. 7.

The wiper system 810 of FIG. 8 uses the application of fluid pressure to a piston 846 positioned in an annulus 872 between the wiper plug assembly 814 and the tubular housing 818. The piston 846 is in contract with the breakable holder 822. A fluid 860 is pumped through an interior passage 864 of the wiper plug assembly 814 and flows through the unsealed joint into the annulus 872. As pressure of the fluid increases in the annulus 872, a downward force is applied to the piston 846, which concentrates stress in the breakable holder 822 causing the breakable holder to break.

In addition to the embodiments and examples of systems and methods of wiping a downhole tubular string provided above, the following are additional illustrative examples.

Example 1. A system comprising a liner hanger; a tubular housing configured to be coupled to an end of the liner hanger; and a wiper plug assembly removably coupled to the tubular housing by a breakable holder or a drillable holder, the wiper plug assembly configured to be coupled to an end of a liner hanger running tool.

Example 2. The system of example 1, wherein the liner hanger running tool and the wiper plug assembly are coupled without the use of threads.

Example 3. The system of examples 1 or 2 further comprising a sealing latch disposed on an end of the liner hanger running tool; and a latch receiver disposed on an end of the wiper plug assembly; wherein the sealing latch engages the latch receiver to couple the liner hanger running tool to the wiper plug assembly.

Example 4. The system of any of examples 1-3, wherein the breakable holder is a frangible disc.

Example 5. The system of any of examples 1-4, wherein the tubular housing includes a threaded end configured to be coupled to a liner string positioned in a wellbore.

Example 6. The system of example 5, wherein the tubular housing forms a section of the liner string.

Example 7. The system of any of examples 1-6, wherein the wiper plug assembly includes an upper assembly portion and a wiper plug separable from the upper assembly portion.

Example 8. The system of example 7, wherein the upper assembly portion is an elongated tubular having an orifice allowing fluid communication between an internal passage of the upper assembly portion and an annulus between the upper assembly portion and the tubular housing.

Example 9. The system of example 8, wherein fluid delivered through the orifice provides a force to the breakable holder.

Example 10. The system of any of examples 1-9, wherein pressure delivered by a fluid in an annulus between the wiper plug assembly and the tubular housing is used to break the breakable holder.

Example 11. The system of any of examples 1-10 further comprising a piston positioned in an annulus between the wiper plug assembly and the tubular housing, the piston in contact with the breakable holder; wherein fluid delivered to the annulus between the wiper plug assembly and the tubular housing exerts a force on the piston that breaks the breakable holder.

Example 12. A liner wiper system comprising a tubular housing configured to be coupled to an end of a liner string to be wiped; a wiper plug assembly removably coupled to the tubular housing by a breakable holder or a drillable holder, the wiper plug assembly having a latch receiver configured to be coupled to a sealing latch of a liner hanger running tool.

Example 13. A method of wiping a downhole tubular string comprising providing a tubular housing having a wiper plug assembly having at least one wiper plug positioned within the tubular housing and secured by a breakable holder or a drillable holder; coupling a running tool to the wiper plug assembly; coupling a first end of tubular housing to a liner hanger; and breaking the breakable holder to release the wiper plug assembly.

Example 14. The method of example 13, wherein the method further comprises prior to coupling the running tool to the wiper plug, coupling a second end of the tubular housing to an end of a liner string positioned in a wellbore.

Example 15. The method of example 14, wherein the tubular housing becomes a last section of the liner string.

Example 16. The method of any of examples 13-15, wherein the method further comprises prior to coupling the running tool to the wiper plug assembly, securing the tubular housing at a rig floor with slips.

Example 17. The method of any of examples 13-16, wherein the method further comprises pressure testing a joint between the running tool and the wiper plug assembly.

Example 18. The method of any of examples 13-17, wherein the breakable holder is broken by mechanical force caused by the weight of the running tool.

Example 19. The method of any of examples 13-17, wherein the breakable holder is broken by fluid pressure acting on either the breakable holder directly or on a piston that engages and breaks the breakable holder.

Example 20. The method of any of examples 13-19, wherein the wiper plug assembly and the running tool are coupled by a non-threaded connection.

Although the present disclosure and its advantages have been described in detail, it should be understood that various changes, substitutions and alterations can be made herein without departing from the spirit and scope of the disclosure as defined by the following examples.

What is claimed is:

1. A system comprising:

a liner hanger;

a tubular housing configured to be coupled to an end of the liner hanger, the tubular housing having a threaded end configured to be threadingly coupled to a liner string positioned in a wellbore; and a wiper plug assembly removably coupled to the tubular housing by a breakable holder, the wiper plug assembly configured to be coupled to an end of a liner hanger running tool.

2. The system of claim 1, wherein the liner hanger running tool and the wiper plug assembly are coupled without the use of threads.

3. The system of claim 1 further comprising:

a sealing latch disposed on an end of the liner hanger running tool;

a latch receiver disposed on an end of the wiper plug assembly;

wherein the sealing latch engages the latch receiver to couple the liner hanger running tool to the wiper plug assembly.

4. The system of claim 1, wherein the breakable holder is a frangible disc.

5. The system of claim 1, wherein the tubular housing forms a section of the liner string.

6. The system of claim 1, wherein the wiper plug assembly includes an upper assembly portion and a wiper plug separable from the upper assembly portion.

7. The system of claim 6, wherein the upper assembly portion is an elongated tubular having an orifice allowing fluid communication between an internal passage of the upper assembly portion and an annulus between the upper assembly portion and the tubular housing.

8. The system of claim 7, wherein fluid delivered through the orifice provides a force to the breakable holder.

9. The system of claim 1, wherein pressure delivered by a fluid in an annulus between the wiper plug assembly and the tubular housing is used to break the breakable holder.

10. The system of claim 1 further comprising:

a piston positioned in an annulus between the wiper plug assembly and the tubular housing, the piston in contact with the breakable holder;

wherein fluid delivered to the annulus between the wiper plug assembly and the tubular housing exerts a force on the piston that breaks the breakable holder.

11. A liner wiper system comprising:

a tubular housing configured to be coupled to an end of a liner string to be wiped;

a wiper plug assembly removably coupled to the tubular housing by a breakable holder, the wiper plug assembly having a latch receiver configured to be coupled to a sealing latch of a liner hanger running tool.

12. A method of wiping a downhole tubular string comprising:

providing a tubular housing having a wiper plug assembly having at least one wiper plug positioned within the tubular housing and secured to the tubular housing by a breakable holder;

coupling a running tool to the wiper plug assembly;

coupling a first end of tubular housing to a liner hanger;

breaking the breakable holder to release the wiper plug assembly;

prior to coupling the running tool to the wiper plug, coupling a second end of the tubular housing to an end of a liner string positioned in a wellbore.

13. The method of claim 12, wherein the tubular housing becomes a last section of the liner string.

14. The method of claim 12, wherein the method further comprises:

prior to coupling the running tool to the wiper plug assembly, securing the tubular housing at a rig floor with slips.

15. The method of claim 12, wherein the method further comprises:

pressure testing a joint between the running tool and the wiper plug assembly.

16. The method of claim 12, wherein the breakable holder is broken by mechanical force caused by the weight of the running tool.

17. The method of claim 12, wherein the breakable holder is broken by fluid pressure acting on either the breakable holder directly or on a piston that engages and breaks the breakable holder.

18. The method of claim 12, wherein the wiper plug assembly and the running tool are coupled by a non-threaded connection.

* * * * *